US005156339A

United States Patent [19]

Gibson et al.

[11] Patent Number: 5,156,339

[45] Date of Patent: Oct. 20, 1992

[54] WATER SPRINKLING LOUNGE CHAIR APPARATUS

[76] Inventors: Kurt A. Gibson; Kim R. Schulz, both of Box 579, Hastings, Nebr. 68902

[21] Appl. No.: 779,324

[22] Filed: Oct. 18, 1991

[51] Int. Cl.[5] ..... B05B 17/00

[52] U.S. Cl. ..... 239/289; 239/565; 239/588; 5/656; 5/928

[58] Field of Search ..... 239/289, 565, 588; 297/180, 191, 194; 5/656, 928

[56] References Cited

U.S. PATENT DOCUMENTS

| | | | |
|---|---|---|---|
| 2,107,813 | 2/1938 | Best | 297/191 |
| 3,233,940 | 2/1966 | Tooley, Jr. | 297/194 |
| 3,461,878 | 8/1969 | Southard | 297/185 |
| 3,625,434 | 12/1971 | Kitover | 239/289 |
| 3,688,775 | 9/1972 | Raymann | 239/289 |
| 4,891,855 | 1/1990 | Cheng-Chung | 5/449 |
| 4,961,535 | 10/1990 | Skibik | 239/289 |
| 4,964,183 | 10/1990 | LeForce, Jr. | 5/449 |

*Primary Examiner*—Andres Kashnikow
*Assistant Examiner*—Karen B. Merritt
*Attorney, Agent, or Firm*—Leon Gilden

[57] ABSTRACT

A lounge chair utilizes a first "U" shaped frame pivotally mounting a second "U" shaped frame, with the first "U" shaped frame including a plurality of legs for positioning the first "U" shaped frame relative to an underlying surface, with each frame including a plurality of sprinkling water ports direction therethrough, wherein the second frame includes a hose connection to permit fluid communication to a fluid conduit utilizing a valve member interposed therebetween to control fluid flow. A modification of the invention includes directional conduits mounted to each "U" shaped frame to permit directional orientation of the port flow as required. Solar reflective slats are directed within the first and second "U" shaped frame.

1 Claim, 4 Drawing Sheets

WATER SPRINKLING LOUNGE CHAIR APPARATUS

BACKGROUND OF THE INVENTION

1. Field of the Invention

The field of invention relates to lawn chair apparatus, and more particularly pertains to a new and improved water sprinkler lounge chair apparatus wherein the same provides fluid flow of water to an occupant of the associated chair to effect cooling in a sunbathing or lounging event.

2. Description of the Prior Art

Sunbathing and lounging during summer months is accompanied by discomfort due to associated perspiration of an individual. The instant invention attempts to overcome deficiencies of the prior art by providing an organization to combine sunbathing and lounging with a coolant flow of water spray to effect cooling of an individual utilizing the organization. Prior art structure exemplified utilizing fluid flow to an occupant in a lounge chair structure is set forth in U.S. Pat. No. 4,548,357 and U.S. Pat. No. 4,765,542.

Accordingly, it may be appreciated that there continues to be a need for a new and improved water sprinkler lounge chair apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of lounge chair apparatus now present in the prior art, the present invention provides a water sprinkler lounge chair apparatus wherein the same provides directional and continuous fluid flow to an individual utilizing the lounge chair apparatus of the invention. As such, the general purpose of the present invention, which will be described subsequently in greater detail, is to provide a new and improved water sprinkler lounge chair apparatus which has all the advantages of the prior art lounge chair apparatus and none of the disadvantages.

To attain this, the present invention provides a lounge chair utilizing a first "U" shaped frame, with the first "U" shaped frame including a plurality of legs for positioning the first "U" shaped frame relative to an underlying surface, with each frame including a plurality of sprinkling water ports directed therethrough, wherein the second frame includes a hose connection to permit fluid communication to a fluid conduit utilizing a valve member interposed therebetween to control fluid flow. A modification of the invention includes directional conduits mounted to each "U" shaped frame to permit directional orientation of the port flow as required.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water sprinkler lounge chair apparatus which has all the advantages of the prior art lounge chair apparatus and none of the disadvantages.

It is another object of the present invention to provide a new and improved water sprinkler lounge chair apparatus which may be easily and efficiently manufactured and marketed.

It is a further object of the present invention to provide a new and improved water sprinkler lounge chair apparatus which is of a durable and reliable construction.

An even further object of the present invention is to provide a new and improved water sprinkler lounge chair apparatus which is susceptible of a low cost of manufacture with regard to both materials and labor, and which accordingly is then susceptible of low prices of sale to the consuming public, thereby making such water sprinkler lounge chair apparatus economically available to the buying public.

Still yet another object of the present invention is to provide a new and improved water sprinkler lounge chair apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
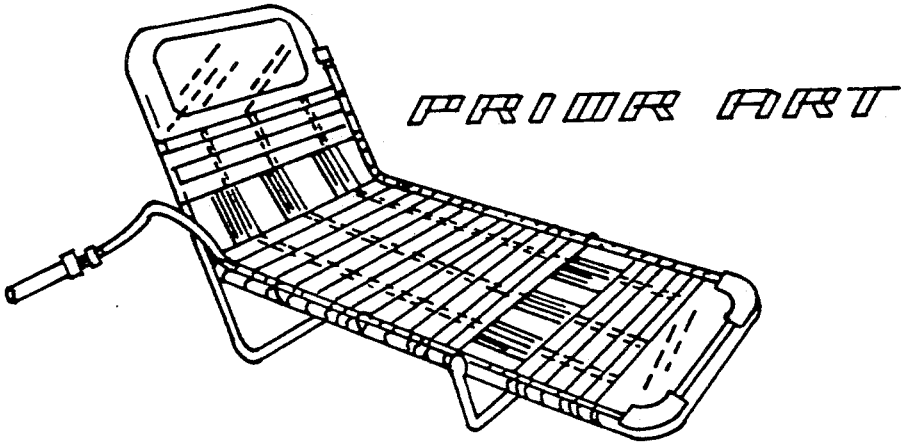
FIG. 1 is an isometric illustration of a prior art lounge chair apparatus.

With reference now to the drawings, and in particular to FIGS. 1 to 8 thereof, a new and improved water sprinkler lounge chair apparatus embodying the principles and concepts of the present invention and generally designated by the reference numeral 10 will be described.

Figure 2:
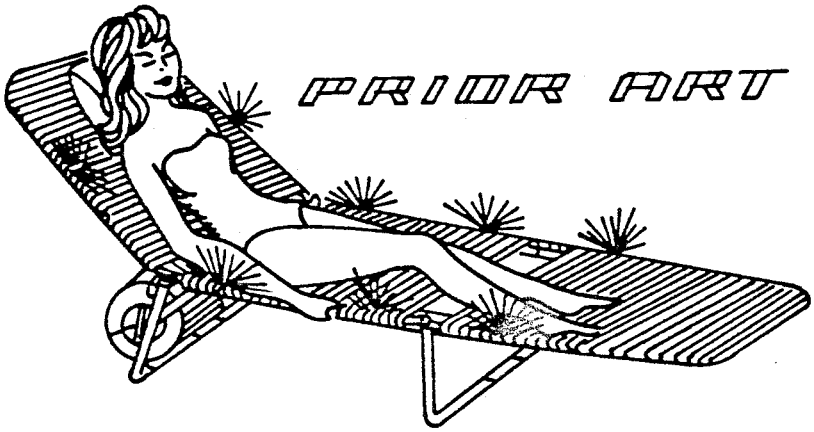
FIG. 2 is an isometric illustration of a further prior art lounge chair apparatus.
Figure 3:
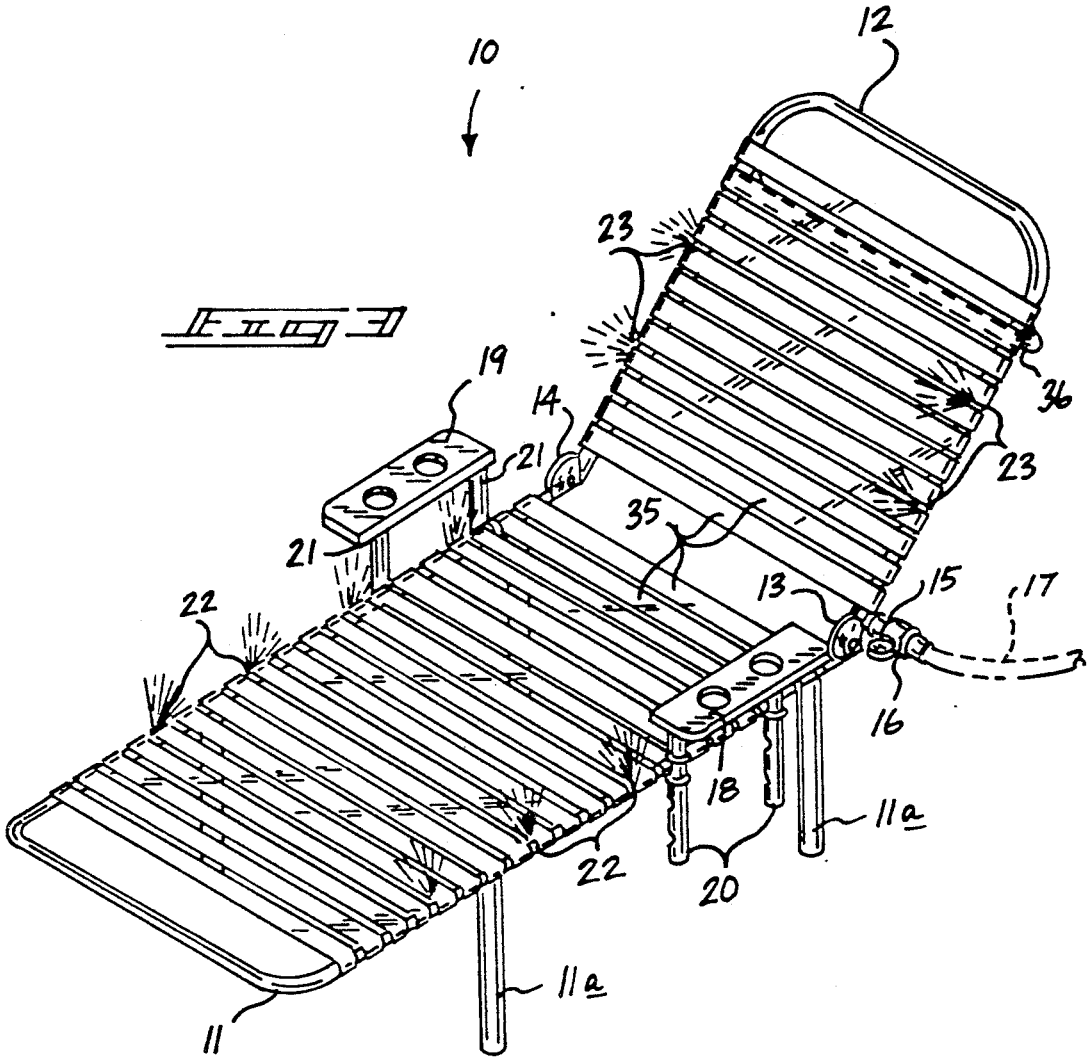
FIG. 3 is an isometric illustration of the instant invention.

FIG. 1 and FIG. 2 illustrate respective examples of prior art lounge chair structure utilizing water output conduits to direct a spray to an associated individual, as set forth in the respective U.S. Pat. Nos. 4,548,357 and 4,765,542 respectively.

More specifically, the water sprinkler lounge chair apparatus 10 of the instant invention essentially comprises a "U" shaped first frame member 11 pivotally mounted to a "U" shaped second frame member 12 about respective right and left hollow pivot hinges 13 and 14 that maintain fluid communication between the first and second frame members 11 and 12. The first and second frame members each include joined legs that are in fluid communication with the legs arranged to receive water directed through the right and left pivot hinges 13 and 14. The second frame member 12 includes a fluid connector 15 mounting a fluid valve 16, wherein the fluid valve 16 is in fluid communication with a fluid conduit 17 to direct fluid through the valve 16 and permit selective fluid flow into the first and second frames 11 and 12. It should be noted that the first frame 11 includes a right and left tubular conduit in fluid communication with a second frame right and left tubular conduit, wherein the right conduits are in fluid communication through the right pivot, with the left first and second frame conduits in fluid communication to the left pivot 14. Further, it should be noted that first frame support legs 11*a* are mounted orthogonally to a bottom surface of the first horizontal frame member 11 to provide elevated support thereof.

Respective right and left apertured cup holder plates 18 and 19 respectively are secured to the spaced right and left legs of the first frame 11 utilizing various clamping arrangements to permit selective and adjustable support of the right and left adjusting legs 20 and 21 of the respective right and left apertured cup holder plates 18 and 19.

The first and second frames 11 and 12 include a plurality of respective first and second outlet spray ports 22 and 23 respectively that are directed along respective right and left legs of the first and second frame members 11 and 12 to direct fluid spray therethrough.

Figure 4:
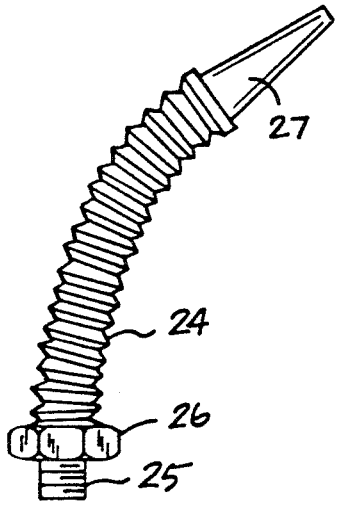
FIG. 4 is an orthographic view of the directional conduit utilized by the invention.
Figure 5:
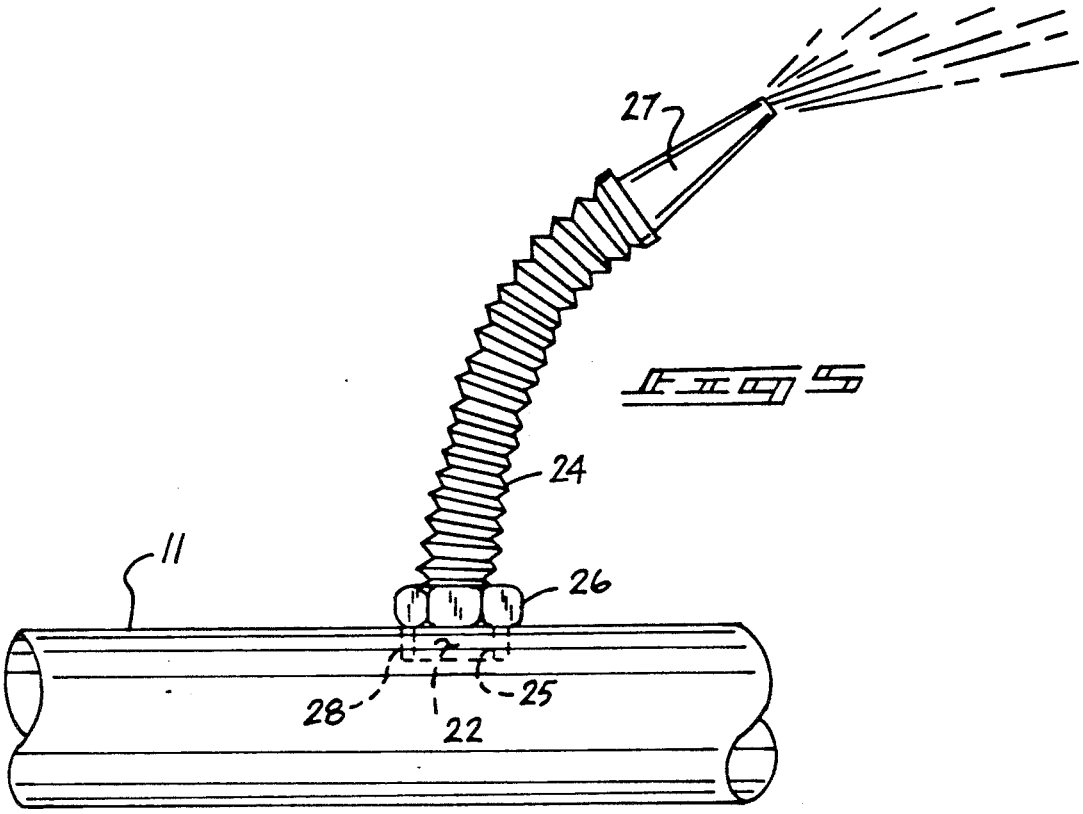
FIG. 5 is an orthographic side view of the directional conduit mounted to the lounge chair apparatus and an associated port thereof.

The FIGS. 4 and 5 illustrate the use of an accordion pleated directional conduit 24 that includes an externally threaded coupling tube 25 formed at a lower terminal end of the directional conduit 24 to include a lock fastener 26. The directional conduit 24 includes a conical nozzle 27 at an upper terminal end thereof to provide for directional spray of fluid directed through the first and second frame members onto an individual. The coupling tubes 25, as illustrated in FIG. 5, are received within a threaded outlet port 28 of each spray port 22 utilizing the lock fastener 26 threadedly mounted upon the tube 25 to effect locking securement of the tube 25 to a respective spray port 22.

Figure 6:
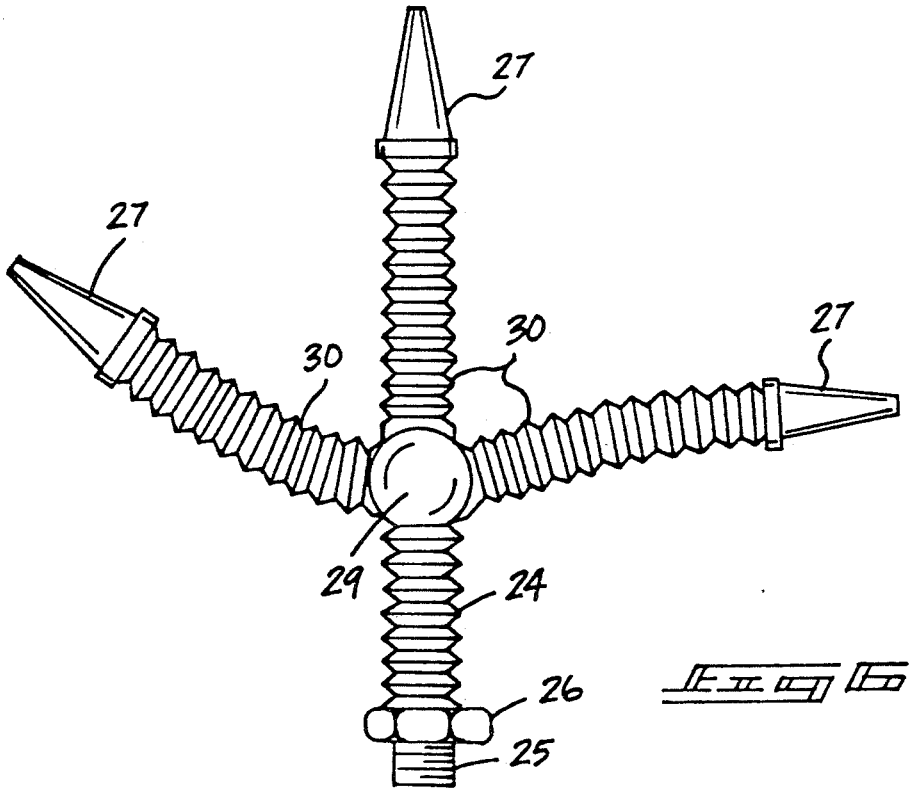
FIG. 6 is an orthographic side view of a modified directional conduit structure utilized by the invention.
Figure 7:
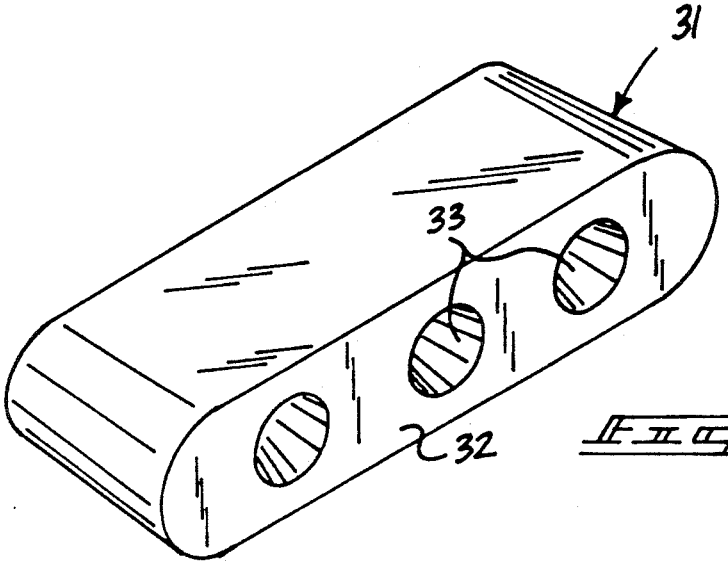
FIG. 7 is an isometric illustration of a spray head utilized by the invention.
Figure 8:
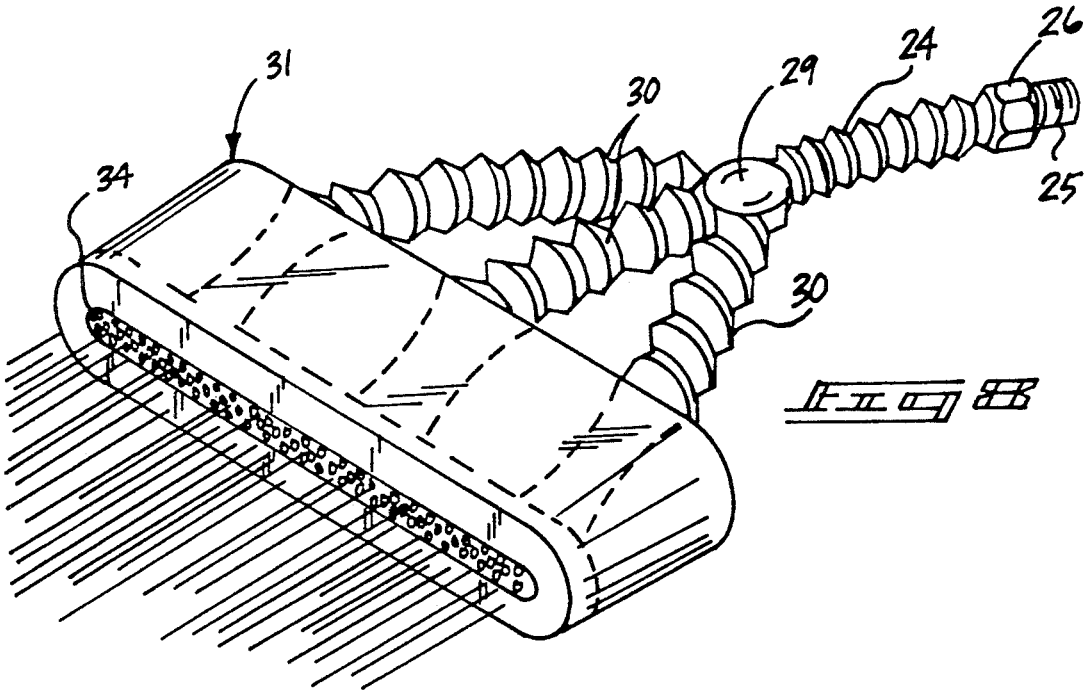
FIG. 8 is an isometric illustration of the spray head mounted to the directional conduit structure of FIG. 6.

FIG. 6 illustrates the use of a modified directional conduit structure to include a primary directional conduit 24, also of an accordion pleated construction, directed into a conduit junction 29. From the conduit junction 29, a plurality of secondary accordion pleated conduits 30 are in fluid communication, with each including an individual conical nozzle 27. To provide for a wide directional applicator spray of a cooling water onto an individual, a spray head 31 is provided. The spray head, as illustrated in the FIGS. 7 and 8, includes a spray head rear wall, with a plurality of conical cavities 33 to receive each respective conical nozzle 27 of the directional conduit structure as set forth in FIG. 6. The conical cavities 33 are in fluid communication with a spray head front wall apertured plate 34 to direct the water spray through the apertures, as illustrated, onto an individual in use.

It should be further noted that the first and second frame members 11 and 12 respectively each include a plurality of flexible solar reflective slats 35 coextensively mounted in an orthogonal relationship between the right and left legs of the respective first and second frame members to aid in a sunbathing event by reflection of solar rays to an individual positioned upon the organization. Further, a "U" shaped towel rack 36 is orthogonally mounted to a rear surface of the second frame member 12 permitting suspension of a towel thereon for use by an individual subsequent to a sunbathing event utilizing water spray from the ports 22 and 23.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water sprinkler lounge chair apparatus, comprising, a "U" shaped first conduit frame and a "U" shaped second conduit frame, the first frame including parallel first frame right and left legs, with the second frame including parallel second frame right and left legs, wherein a right hollow pivot hinge effects fluid communication between the first frame right leg and the second frame right leg, and a left hollow pivot hinge in fluid communication and pivotally mounting the first frame left leg and the second frame left leg, and a fluid valve mounted to the first frame, with the fluid valve including a fluid conduit secured therethrough to direct fluid flow into the first frame and the second frame, and the first frame right and left legs including a plurality of parallel flexible solar reflective slats orthogonally directed between the first frame right and left legs, and the second frame right and left legs including a further plurality of spaced flexible solar reflective slats directed orthogonally between the second frame right and left legs, and the first frame including a plurality of first outlet spray ports, and the second frame including a plurality of second outlet spray ports to direct fluid flow through the spray ports from the fluid conduit, and each of the first and second outlet spray ports includes an internally threaded wall and a plurality of directional conduits, each directional conduit including an externally threaded coupling tube arranged for securement into said internally threaded wall of each spray port, and each coupling tube including an accordion pleated conduit member mounted to an upper terminal end of each coupling tube, and each conduit member in fluid communication with at least one conical nozzle, and each conduit member includes a conduit junction, and each conduit junction includes a predetermined number of secondary conduits, each secondary conduit including an accordion pleated construction and each secondary conduit including said at least one conical nozzle mounted thereto, and a spray head, the spray head including a rear wall and a front wall, the rear wall including a plurality of conical cavities equal in number to the predetermined number of secondary conduits, and each conical cavity complementarily receiving one of said conical nozzles therewithin, and the front wall of the spray head including an apertured plate coextensive therewith, wherein the apertured plate is in fluid communication with the conical cavities to direct fluid flow through the apertured plate from the conical cavities directed through the rear wall of the spray head.

* * * * *